United States Patent [19]

Gien et al.

[11] Patent Number: 4,753,302

[45] Date of Patent: Jun. 28, 1988

[54] VALVELESS PNEUMATIC HAMMER

[76] Inventors: Abraham Gien, 60 Van Beek Street, New Doornfontein, Johannesburg; Bernard L. Gien, P.O. Box 202, Halfway House 1685, Transvaal, both of South Africa

[21] Appl. No.: 862,330

[22] Filed: May 12, 1986

[30] Foreign Application Priority Data

Apr. 29, 1986 [ZA] South Africa ..... 86/3192

[51] Int. Cl.[4] ..... B23Q 5/00

[52] U.S. Cl. ..... 173/17; 173/73; 173/80

[58] Field of Search ..... 173/17, 73, 80, 134

[56] References Cited

U.S. PATENT DOCUMENTS 4,402,370 9/1983 Gein et al. ..... 173/73

4,530,407 7/1985 Rear ..... 173/17

*Primary Examiner*—E. R. Kazenske

*Assistant Examiner*—Willmon Fridie, Jr.

*Attorney, Agent, or Firm*—McAulay, Fields, Fisher, Goldstein & Nissen

[57] ABSTRACT

A valveless pneumatic hammer comprising a backhead assembly at one end of a hollow casing and a bit assembly at the other end of the casing, a rod extending into the casing and having a passage out to atmosphere at the other end of the assembly, a chamber divider in the backhead end of the casing having a control rod projecting into the casing, a piston having a large bore in one end and a smaller bore end and the larger bore end being adapted to cooperate with the chamber divider end for the sealing of the larger bore, the piston reciprocating between a first position with the smaller bore end against the bit assembly, and a second position with the piston displaced towards the backhead assembly, a first chamber with the piston in the first position, a second chamber with the piston in the second position, first and second fluid supply paths through the backhead assembly, between chamber divider walls and the casing wall, first and second fluid exhaust paths from the first and second chambers, respectively out into atmosphere, and a second fluid exhaust from the second chamber out to atmosphere, wherein the hammer is characterized by the chamber divider and the backhead assembly being integral and at least one passage formed between the casing wall and the piston, in the first piston position, in the first fluid supply path includes a concentric, annular recess in the middle region of the casing wall and the outer surface of the piston includes a first fluid passage from the backhead end thereof to a position adjacent the middle region thereof and a second fluid passage from a position adjacent the middle region thereof, remote from the first fluid passage, to the bit end thereof.

16 Claims, 2 Drawing Sheets

VALVELESS PNEUMATIC HAMMER

This invention relates to a hammer of the valveless pneumatic type which is generally used for "down the hole" drilling.

The parent U.S. Pat. No: 4,402,370 describes a pneumatic, valveless hammer comprising a hollow casing with an operatively upper and lower end, and, which has a piston therein reciprocating between an upper and a lower pressure chamber. The hammer also has a bit assembly at the lower casing end and a backhead assembly at the upper casing end. This type of hammer operates adequately, but has a complicated split ring formation adjacent the lower end of the backhead assembly to locate a chamber divider in position. This formation is difficult to manufacture thus increasing the cost of the hammer. Furthermore, two annular recesses are cut into the interior casing wall to provide fluid flow paths, which is an expensive and time consuming operation.

It is an object of this invention to provide a valveless pneumatic hammer which has features which alleviate the abovementioned problems.

In accordance with this invention there is provided a valveless pneumatic hammer comprising:

a hollow casing;

a backhead assembly at one end of the casing;

a bit assembly at the other end of the casing, having a rod extending into the casing and having a passage into the rod end and passing out to atmosphere at the other end of the assembly;

a chamber divider in the backhead end of the casing having a control rod projecting into the casing, the innermost end of the divider being adapted to seal against a piston bore during a portion of piston movement in use;

a piston having a large bore in one end and a smaller concentric bore through the other end into the larger bore, the larger bore end being adapted to co-operate with the chamber divider end for the sealing of the larger bore, the piston being further adapted to reciprocate between two positions, the first position being with the smaller bore end against the bit assembly where the bit assembly rod within and sealing off the smaller bore and the larger piston bore sealed off by the chamber divider end, and the second position being with the piston displaced towards the backhead assembly, the larger bore unsealed and the chamber divider control rod within and sealing off the smaller bore, and with the bit assembly rod removed from the smaller bore;

a first chamber with the piston in the first position, formed around a bit assembly portion extending into the casing from a stepped portion of the casing;

a second chamber with the piston in the second position, formed by the larger bore of the piston and the annular recess in the chamber divider;

a first fluid supply path through the backhead assembly, between the chamber divider walls and the casing wall, into at least one passage formed between the casing wall and the piston, in the first piston position, and into the first chamber;

a second fluid supply path through the backhead assembly, between the chamber divider walls and casing wall, between the unsealed chamber and piston ends in the second position of the piston and into the second chamber;

a first fluid exhaust path from the first chamber into the bit assembly passage with the piston in the second position and out into atmosphere; and, a second fluid exhaust path from the second chamber through the smaller piston bore with the piston in its first position, into the bit assembly passage and out to atmosphere;

the hammer being characterised in that the chamber divider and the backhead assembly are integral and that the at least one passage formed between the casing wall and the piston, in the first piston position, in the first fluid supply path includes a concentric, annular recess in the middle region of the casing wall and the outer surface of the piston includes a first fluid passage from the backhead end thereof to a position adjacent the middle region thereof and a second fluid passage from a position adjacent the middle region thereof, remote from the first fluid passage, to the bit end thereof.

A feature of the invention provides for the first and second fluid passages to be formed by slots cut into the outer surface of the piston.

Further according to the invention, the first fluid passage may be formed by a concentric, annular, inwardly stepped, recess on the backhead end of the piston and the second fluid passage may be formed by a concentric annular, inwardly stepped recess on the bit end of the piston where the recesses are remote from one another.

One embodiment of the invention is described below by way of example, and with reference to the accompanying drawings in which.

Figure 1:
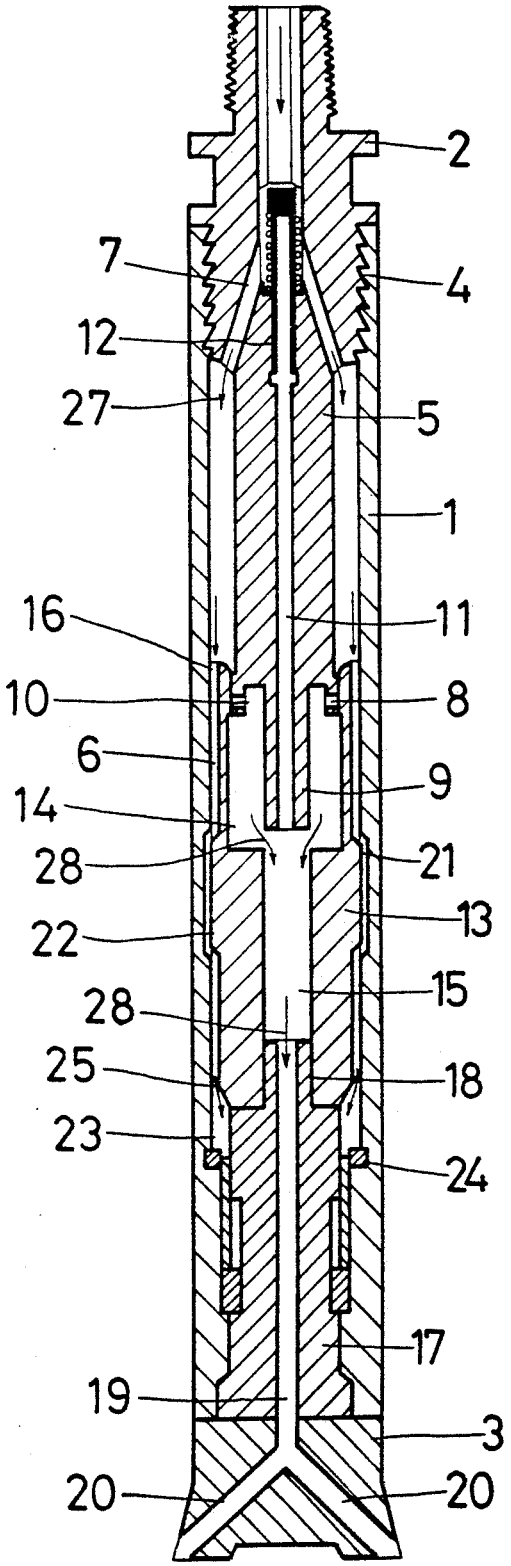
FIG. 1 is a cross-sectional view of a valveless pneumatic hammer with piston in a first position.

A hollow casing (1) has a backhead assembly (2) at one end thereof, and a bit assembly (3) at the other end.

The backhead assembly is secured in the casing end by internal screw-threading (4) in the casing. A chamber divider (5) is integral with the backhead assembly but extends axially below the backhead assembly in use. Inlet passages (7) are located in the backhead assembly. This chamber divider has an outwardly stepped portion (8) at the end thereof remote from the backhead assembly, and a central control rod (9) projecting from this end. An annular recess (1) is located in this end around the central control rod (9). A central bore (11) extends through the control rod from end to end to a non return valve assembly (12) in the backhead assembly.

A piston (13) has a large bore (14) in one end thereof and a smaller bore (15) in the other end thereof, which extends through to the larger bore. The large bore end of the piston has an inwardly stepped section (16), which is slidable in airtight manner over the outer surface of the outwardly stepped section (8) of the chamber divider.

The bit assembly (3) has a shaft (17) which has a protruding rod (18) extending into the small bore (15). The assembly (3) is slidable within the casing between predetermined limits. This degree of slide is achieved, and the assembly is located within the casing, in any suitable manner. A portion of the shaft (17) extends into the casing interior from a stepped section of the casing, and the degree of slide of the bit assembly allows it to move between a raised position in which the said shaft portion is in the casing interior and a lowered position where the bit assembly end is flush with the stepped section of the casing.

A passageway (19) passes through the end of the projecting rod (18) through to the atmosphere out of the bottom of the bit assembly. This passage (19) divides into one or more separate passages (20) in the outer portion of the bit assembly and these passages (20) communicate with atmosphere at the side of the bit assembly.

A concentric annular recess (21) is located in the casing, near the centre of the interior of the casing. The piston has, in effect, a concentric, outwardly stepped, annular portion (22), formed by slots (6) cut into either end of the piston. A first and second fluid passage being formed by the slots above and below the outwardly stepped annular portion respectively.

The piston is adapted to reciprocate between two positions. The first position (FIG. 1) is with the piston against the bit assembly in its raised condition, and with the bit assembly rod (18) extending fully into the small bore (15) of the piston. In this position a first chamber (23) is formed around the bit assembly and is defined by the wall of the bit assembly at this position, the casing wall opposite it, the stepped portion (24) of the bit and the overlapping portion (25) of the piston.

Further in this position the recess (21) with the first chamber (23) and with the casing interior just past the larger bore end of the piston through slots (6). The inwardly stepped portion of the chamber divider and the inwardly stepped portion (16) of the piston are opposite each other end seal off the large bore (14) of the piston, and the annular recess (10) of the chamber, from the interior of the casing.

Figure 2:
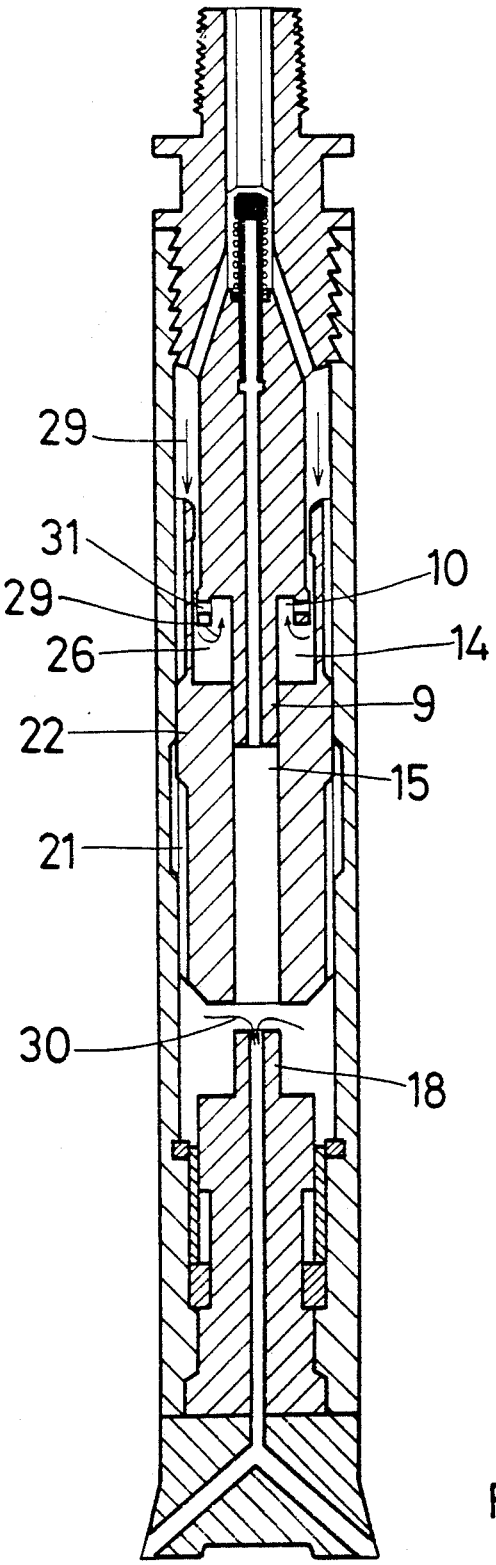
FIG. 2 is a cross-sectional view of a valveless pneumatic hammer with piston in a second position.

In the second position of piston movement (FIG. 2) the piston is displaced towards the backhead assembly, the small bore end of the piston is removed from the projecting rod (18) of the bit assembly, and the inwardly stepped section (16) of the piston has now slid past the outwardly stepped portion (8) of the chamber divider, as illustrated. In this position the control rod (9) of the chamber divider is within the small bore (15) of the piston, and the casing recess (21) is sealed off from the interior of the casing by the piston stepped portion (22). At the small bore end the projecting rod (18) is removed from the bore of the piston. A second chamber (26) is formed with the piston in this position and is defined by the large bore (14) of the piston and the recess (10) in the chamber divider.

A first fluid supply path (27), see FIG. 1, starts through the backhead assembly past the chamber divider and the casing walls into the slots (6) and then into casing recess (21), with the piston and into the first chamber (23). This first fluid supply path is clearly indicated by the arrows (27) in FIG. 1 of the drawings.

A second fluid exhaust path (28), see FIG. 1 from the second chamber (26) passes from the chamber (26) into the small bore of the piston from there into the passage (19) in the bit assembly and out to atmosphere. The exhaust path is indicated by arrows (28) in FIG. 1.

A second fluid supply path, with the piston in its second position (FIG. 2), passes through the backhead assembly between the chamber divider and casing wall and between the inner wall of the large bore of the piston and the outer wall of the chamber divider into the second chamber (26). This path is clearly indicated by arrows (29) in FIG. 2.

A first fluid exhaust path passes from the position, directly into the passage (19) in the bit assembly and through this passage out to atmosphere. This exhaust path is indicated by arrows (30) in FIG. 2.

A radial opening (31) through the wall of the chamber divider is located at the outwardly stepped portion (8) thereof. The opening is positioned so that it communicates between the second fluid chamber (26) and the passage between the chamber divider and the casing wall when the inwardly stepped section (16) of the piston is on the bit assembly side of the opening (31).

In use, air under pressure is admitted to the casing by the backhead assembly and passes along the first fluid path into the first fluid chamber where the pressure causes the piston to move towards the backhead assembly and position two. Clearly the end piston surface exposed to pressure in chamber (23) has a larger area than the end surface of the piston at the large bore end.

As the piston moves towards its second position the rod (18) is removed from the second chamber (23) and air from the chamber follows the first fluid exhaust path.

The piston moves towards its second position and the entrance to the grooves at the backhead end is closed off by the piston moving over it and the second fluid supply path is opened by the inwardly stepped section (16) of the piston moving passed the outwardly stepped section (8) of the chamber divider. A second fluid supply path is thus open, and air follows this path into the second chamber (26).

The pressure in this chamber causes the piston to commence moving back towards the bit assembly (3). Once the piston has moved sufficiently far from the projecting rod (9) of the chamber divider to be removed from the small bore (15) of the piston, the second fluid exhaust path is now open, and air from chamber (26) exhausts along this path out to atmosphere.

It will be appreciated that the recess (10) increases the volume of chamber (26) and thus reduces a build up of pressure caused by the piston returning to its second position. This effect is achieved without increasing the overall length of the hammer and represents thus a saving in materials and allows for easier manoeuvrability of the hammer.

Further, air following both of the fluid exhaust paths passes through the bit assembly and thus serves to remove drilling material from the borehole that may have lodged therein.

Preferably the depth of the recess (21) is also not greater than the depth of the internal screw threading of the backhead end.

If the casing is raised off the surface being drilled, the bit assembly drops to its lower position with the piston resting thereon. In this position, the end of the stepped portion (16) of the piston uncovers the opening (31), which communicates between chamber (26) and the passage between the casing wall and the chamber divider. Air thus follows the path between casing wall and chamber divider, through the opening (31) and into chamber (26) and out along the exhaust path (28) to atmosphere through the bit assembly. This allows for continuous flushing of the borehole and the bit assembly, and since all the air supply being supplied to the machine is exhausted as described, the machine is inactive in this condition.

It is considered that the invention provides an effective pneumatic hammer which alleviates difficulties experienced in prior art hammers of the same type.

What we claim is:

1. A valveless pneumatic hammer, comprising:

a hollow casing having an inner wall;

a backhead assembly at one end of the casing;

a bit assembly at the other end of the casing, having a rod (18) extending into the casing and having a passage into the rod end and passing out to atmosphere at the other end of the assembly;

a chamber divider integral with the backhead end of the casing and having a control rod (9) projecting into the casing, the innermost end of the divider being adapted to seal against a piston bore during a portion of piston movement in use, and said chamber divider having outer walls;

a piston having a large bore in one end and a smaller concentric bore through the other end into the larger bore, the larger bore end being adapted to cooperate with the chamber divider end for the sealing of the larger bore, the piston being further adapted to reciprocate between two positions, the first position being with the smaller bore against the bit assembly with the bit assembly rod within and sealing off the smaller bore and the larger piston bore sealed off by the chamber divider end, and the second position being with the piston displaced towards backhead assembly, the larger bore unsealed and the chamber divider control rod within and sealing off the smaller bore, and with the bit assembly rod removed from the smaller bore;

a first chamber with the piston in the first position, formed around a bit assembly portion extending into the casing from a stepped portion of the casing;

a second chamber with the piston in the second position, formed by the larger bore of the piston and an annular recess in the chamber divider;

a first fluid supply path through the backhead assembly, between the chamber divider outer walls and the casing wall, into at least one passage formed between the casing wall and the piston in the first position and into the first chamber;

a second fluid supply path through the backhead assembly, between the chamber divider walls and the casing wall, between the unsealed chamber and piston ends in the second position of the piston and into the second chamber;

a first fluid exhaust path from the first chamber into the bit assembly passage with the piston in the second position and then out into atmosphere;

a second fluid exhaust from the second chamber through the smaller piston bore with the piston in its first position, into the bit assembly passage and then out to atmosphere;

said at least one passage formed between the casing wall and the piston, in the first piston position, in the first fluid supply path includes a concentric annular recess in the middle region of the casing wall; and the outer surface of said piston includes a first fluid passage from the backhead end thereof to a position adjacent the middle region thereof and a second fluid passage from a position adjacent the middle region thereof, remote from the first fluid passage, to the bit end thereof.

2. A valveless pneumatic hammer as claimed in claim 1, in which the first and second fluid passages are isolated from each other by a middle region.

3. A valveless pneumatic hammer as claimed in claim 1, in which the first and second fluid passages in the outer surface of the piston are formed by slots cut into the outer surface of the piston.

4. A valveless pneumatic hammer as claimed in claim 3, in which said first and second fluid passages are isolated from each other by a middle region.

5. A valveless pneumatic hammer as claimed in claim 1, in which said first fluid passage is formed by a concentric, annular, inwardly stepped recess on the backhead end of the piston and the second fluid passage is formed by a concentric, annular, inwardly stepped recess on the bit end of the piston where the recesses are remote from one another, and a middle region isolating said first and second fluid passages from each other.

6. A valveless pneumatic hammer as claimed in claim 3, in which said first fluid passage is formed by a concentric, annular, inwardly stepped recess on the backhead end of the piston and the second fluid passage is formed by a concentric, annular, inwardly stepped recess on the bit end of the piston where the recesses are remote from one another, and a middle region isolating said first and said second fluid passages from each other.

7. A valveless pneumatic hammer, comprising:

a hollow casing having at least one wall;

a backhead assembly at one end of the casing;

a bit assembly at the other end of the casing, having a rod (18) extending into the casing and having a passage into the rod end and passing out to atmosphere at the other end of the assembly;

a chamber divider having chamber divider walls, said chamber divider being integral with the backhead end of the casing and having a control rod (9) projecting into the casing, the innermost end of the divider being adapted to seal against a piston bore during a portion of piston movement in use;

a piston having a large bore in one end and a smaller concentric bore through the other end into the larger bore, the larger bore end being adapted to cooperate with the chamber divider end for the sealing of the larger bore, the piston being further adapted to reciprocate between two positions, the first position being with the smaller bore against the bit assembly with the bit assembly rod within and sealing off the smaller bore and the larger piston bore sealed off by the chamber divider end, and the second position being with the piston displaced towards backhead assembly, the larger bore unsealed and the chamber divider control rod within and sealing off the smaller bore, and with the bit assembly rod removed from the smaller bore;

a first chamber with the piston in the first position, formed around a bit assembly portion extending into the casing from a stepped portion of the casing;

a second chamber with the piston in the second position, formed by the larger bore of the piston and an annular recess in the chamber divider;

a first fluid supply path through the backhead assembly, between the chamber divider walls and the casing wall, into at least one passage formed between the casing wall and the piston in the first position and into the first chamber;

a second fluid supply path through the backhead assembly, between the chamber divider walls and the casing wall, between the unsealed chamber and piston ends in the second position of the piston and into the second chamber;

a first fluid exhaust path from the first chamber into the bit assembly passage with the piston in the second position and then out into atmosphere; and a second fluid exhaust from the second chamber through the smaller piston bore with the piston in its first position, into the bit assembly passage and then out to atmosphere.

8. The valveless pneumatic hammer as claimed in claim 7, wherein said chamber divider and said backhead assembly together solely define one end of said first fluid supply path and said second fluid supply path.

9. The valveless pneumatic hammer as claimed in claim 7, wherein said piston includes a stepped portion and said casing includes a concentric annular recess, said stepped portion of said piston cooperating with said annular recess to form a fluid flow path therebetween to permit fluid to pass therebetween in the first position of said piston, and said stepped portion forming in the second position of said piston being removed from said annular recess and forming with the inner wall of said casing a seal dividing said fluid flow path into two separate paths isolated from each other.

10. The valveless pneumatic hammer as claimed in claim 9, wherein said piston includes cut into the outer surface thereof slots on opposite sides of said stepped portion.

11. The valveless pneumatic hammer as claimed in claim 9, wherein the portion of said piston above said seal is provided with a concentric, annular, inwardly stepped recess.

12. The valveless pneumatic hammer as claimed in claim 9, wherein the portion of said piston below said seal is formed by a concentric, annular, inwardly stepped recess.

13. The valveless pneumatic hammer as claimed in claim 11, wherein the portion of said piston below said seal is formed by a concentric, annular, inwardly stepped recess.

14. The valveless pneumatic hammer as claimed in claim 7, wherein the backhead end of said piston and the bit end of said piston are each formed by concentric, annular, inwardly stepped recesses which are separated by a middle portion, said middle portion preventing fluid communication between the recess at the backhead end of said piston and the bit end of said piston in the second position of said piston, and said casing including pathway means cooperating with said middle portion to provide fluid communication between said recesses in the first position of said piston.

15. The valveless pneumatic hammer as claimed in claim 8, wherein the backhead end of said piston and the bit end of said piston are each formed by concentric, annular, inwardly stepped recesses which are separated by a middle portion, said middle portion preventing fluid communication between the recess at the backhead end of said piston and the bit end of said piston in the second position of said piston, and said casing including pathway means cooperating with said middle portion to provide fluid communication between said recesses in the first position of said piston.

16. A valveless pneumatic hammer as claimed in claim 1 in which the first and second fluid passages in the outer surface of the piston are formed by slots cut into the outer surface of the piston.

* * * * *